United States Patent [19]

Paukovits, Jr. et al.

[11] Patent Number: 4,874,337

[45] Date of Patent: Oct. 17, 1989

[54] METHOD OF MOUNTING A REPLACEABLE EMI SPRING STRIP

[75] Inventors: Edward J. Paukovits, Jr., Hershey; Susan E. Wright, Harrisburg, both of Pa.

[73] Assignee: AMP Incorporated, Harrisburg, Pa.

[21] Appl. No.: 275,292

[22] Filed: Nov. 23, 1988

[51] Int. Cl.[4] ..... H01R 13/648

[52] U.S. Cl. ..... 439/609; 439/827; 29/876

[58] Field of Search ..... 439/607, 608, 609, 610, 439/497, 92–96, 108, 827; 29/876

[56] References Cited

U.S. PATENT DOCUMENTS

| | | | |
|---|---|---|---|
| 2,280,728 | 4/1942 | Streib | 439/827 |
| 3,136,593 | 6/1964 | Ehrman et al. | 439/609 |
| 3,324,234 | 6/1967 | Hervig | 174/135 |
| 3,466,590 | 9/1969 | Sylvester | 439/609 |
| 3,521,222 | 7/1970 | Andrews | 439/609 |
| 3,609,632 | 9/1971 | Vetter | 439/258 |
| 3,678,445 | 7/1972 | Brancaleone | 439/609 |
| 3,897,125 | 7/1975 | Anderson | 439/609 |
| 4,033,654 | 7/1977 | Ross | 439/609 |
| 4,082,410 | 4/1978 | Storck et al. | 439/827 |
| 4,106,839 | 8/1978 | Cooper | 439/609 |
| 4,120,557 | 10/1978 | Horrocks | 439/827 |
| 4,239,318 | 12/1980 | Schwartz | 439/609 |
| 4,248,492 | 2/1981 | Snyder | 439/312 |
| 4,326,768 | 4/1982 | Punako | 439/609 |
| 4,349,241 | 9/1982 | Juris et al. | 439/88 |
| 4,423,919 | 1/1984 | Hillis | 439/609 |
| 4,426,127 | 1/1984 | Kubota | 439/609 |
| 4,428,639 | 1/1984 | Hillis | 439/609 |
| 4,456,325 | 6/1984 | Benz | 439/827 X |
| 4,470,657 | 9/1984 | Deacon | 439/609 |
| 4,493,525 | 1/1985 | Hall et al. | 439/610 |
| 4,512,623 | 4/1985 | Tomsa | 439/609 |
| 4,529,257 | 7/1985 | Goodman et al. | 439/271 |
| 4,550,960 | 11/1985 | Asick et al. | 439/61 |
| 4,563,052 | 1/1986 | Dietrich | 439/610 |
| 4,655,532 | 4/1987 | Hillis et al. | 439/607 |
| 4,655,533 | 4/1987 | Haag | 439/607 |
| 4,673,236 | 6/1987 | Musolff et al. | 439/609 |

OTHER PUBLICATIONS

AMP Publication No. 4676-8 Rev. 9/15/88, "Military ARINC 600 Connector System", Sep. 15, 1988.

*Primary Examiner*—Neil Abrams
*Assistant Examiner*—Khiem Nguyen
*Attorney, Agent, or Firm*—Anton P. Ness

[57] ABSTRACT

A plug-like conductive shell 10 of an electrical connector includes a peripheral recess 20 therearound in which is disposed a metal strip 50 having a plurality of spring fingers 66,68 for EMI protection upon mating with a receptacle-like conductive shell of a mating connector. The EMI strip 50 is held in place by one or two elastomeric rings 52. A first system includes a ridge 24 in the shell recess bottom 32 and a corresponding formed ridge 60 in the metal strip 50 disposed thereover, with a pair of rings 52 one on each side of the formed ridge 60 securing the strip 50 against axial movement. A second system includes a groove 102 in the shell recess bottom 104 and a corresponding formed ridge 106 in the metal strip 108 disposed therein, defining a corresponding groove 114 within which is disposed a single ring 112, securing the strip 108 against axial movement. The EMI strip 50 is easily assembled to the shell 10 and is easily removable and replaceable, and retrofitting preexisting in-service connectors is possible to replace damaged EMI spring strips even if originally conventionally secured to the shell.

17 Claims, 5 Drawing Sheets

40
42
16
18
10
72
70
52
24
60
74
52
66
50
68
22
20
14
40
10
42
72
70
52
50
24
66
68

METHOD OF MOUNTING A REPLACEABLE EMI SPRING STRIP

FIELD OF THE INVENTION

The present invention relates to electrical connectors and more particularly to connectors shielded against electromagnetic interference.

BACKGROUND OF THE INVENTION

Electrical connectors are known which include metal or conductive shells around dielectric inserts housing the plurality of electrical terminals, so that the metal shells shield the terminals and their signal transmissions from the influence of electromagnetic interference (EMI) commonly present in the environment. The metal shells have forward ends which extend beyond the forward ends of the respective terminals within the inserts so to providea complete conductive periphery, are associated one within the other in a plug and receptacle relationship. In order for the terminals of the mating connectors to mate in a precisely aligned manner, the shell forward ends perform initial centering prior to terminals engaging each other, and a controlled radial spacing is defined between the plug shell foward end and the receptacle shell forward end therearound when mated. The shells are electrically interconnected by a grounding means which commonly comprises a plurality of spring portions attached in strip form to one of the shells near its forward end, so that the spring portions extend radially to be engaged by the other shell upon connector mating, whereafter the spring portions remain under slight spring bias commoning the shells with each other at a plurality of locations completely surrounding the terminals mated at the mating interface of the connectors. Most commonly such spring strips are secured to the plug-type shell, around and facing radially outwardly from the forward end for the outwardly extending spring portions to engage the inside surface of the receptacle-type shell upon connector mating.

Conventional securing techniques include welding, bonding, swaging, magneforming and soldering, such as in U.S. Pat. No. 4,673,236 wherein a pair of strips with mutually offset spring arms are secured within a shell recess by spot welding. Mechanical securing of EMI spring strips commonly involves special shell structure beyond a simple annular recess, or special assembly steps, or both: examples are found in U.S. Pat. Nos. 4,512,623 and 4,655,533 in which leading and trailing edges of the annular strip disposed in an annular shell recess are secured beneath undercuts of the recess walls to hold the strip to the shell; U.S. Pat. Nos. 4,428,639 in which an inwardly directed flange of the strip's trailing edge is mechanically held against a radical shell flange by being wedged by a compression ring having been deformed; and U.S. Pat. Nos. 3,678,445 and 4,248,492 in which outwardly extending spring tabs at the strip's trailing edge abut against a radial shell flange urging a leading strip edge against a ledge or beneath an undercut. In U.S. Pat Nos. 4,239,318, 4,326,768 and 4,470,657 the ends of the EMI spring strips are fastened, soldered, or welded together to define bracelet-like annular strips which are continuous and elastically flexible to be stretched while being mounted over the forward shell end and seated within an annular recess having an outer diameter slightly larger than the inner diameter of the strip when unstreteched.

One electrical connector is sold by AMP Incorporated, Harrisburg, Pa. under the trade designation ARINC 600 Connector, Part No. 213011-1in which a plug-like metal shell of the connector has secured around its periphery an EMI strip of spring fingers, which strip is located within an annular recess near the shell forward end and bonded in place by adhesive material. Within the recess is a small annular ridge which comprises a strip locating means, and the EMI strip has a continuous annular body section which includes an outwardly extending ridge defining a groove along the inside surface within which the shell ridge is received, locating and aligning the strip prior to bonding. The EMI strip includes both forwardly and rearwardly extending spring fingers where the forwardly extending fingers first engage a mating receptacle-type shell leading end before the electrical contacts within the connectors engage, and the rearward fingers continuously engage the mating shell's inside surface after mating.

In U.S. Pat. No. 4,529,257 an annular EMI grounding member is seated within an annular recess of a plug-type shell in one embodiment and comprises a continuous coil spring partially embedded within an intermediate portion of a sleeve-like ring of elastomeric material in which leading and trailing portions of the ring sealingly engage surfaces of the mated connector shells, while exposed surfaces of the coil spring engage surfaces of the mated shells, whereby the member simultaneously provides grounding and environmental sealing between the connector shells.

It is desirable to provide an EMI spring strip for a connector shell which is easy and economical to assemble.

It is desirable to provide such an EMI spring strip which is securable to a shell requiring only simple structural features on the shell.

It is desirable to provie an EMI spring strip not required to be joined to be continuous prior to assembly nor to require bonding, welding, soldering or the like to the shell.

It is further desirable to provide an EMI spring strip which is easily removable from and replaceable on the shell.

SUMMARY OF THE INVENTION

The present invention comprises a member for providing grounding connections between metal shells of electrical connectors for EMI protection, wherein a strip of spring fingers is wrapped around a plug-type shell within a recess thereof and is held in place by an elastomeric ring member or pair of members, such as O-rings. One O-ring acts in cooperation with a ring-receiving groove of the strip in turn disposed within a corresponding annular shell groove; alternatively a pair of O-rings are seated within spaced grooves of a strip on both sides of an annular ridge of the strip disposed over a ridge of the shell. A pair of spaced shell ridges also may define a groove therebetween, and two O-rings may be used side-by-side. Given a wider shell groove and corresponding EMI strip groove, an elastomeric band may be used having a rectangular cross-section. For ease of assembly and removal from the shell it is preferred that the strip not be joined at its ends but merely be of a length to just meet when secured to the shell within the recess by the O-ring or O-rings. Spring arms preferably extend from a central strip body section both forwardly toward a leading edge of the strip and rearwardly toward a trailing edge, to engage the mating receptacle-type shell. The EMI strip and O-rings are usable on either rectangular or cylindrical connector shells, and retrofitting pre-existing in-service connectors is possible.

It is an objective of the present invention to provide an EMI spring finger strip easily and economically manufactured and assembled to a plug-type connector shell without separate processes such as welding or soldering.

It is also an objective to provide an EMI strip which is easily removable from a shell and replaceable without fixturing or tooling.

It is an additional objective to provide a means for retrofitting connectors already in service having damaged EMI strips conventionally secured, in order to continue use of the existing connectors.

It is a further objective to provide EMI strips which can be manufactured in continuous strip form on reels and cut to length at the assembly station for any of several sizes and shapes of connector shells, and immediately assembled.

Embodiments of the present invention will now be described with reference to the accompanying drawings.

DETAILED DESCRIPTION OF THE PREFERRED EMBODIMENTS

Figure 1:
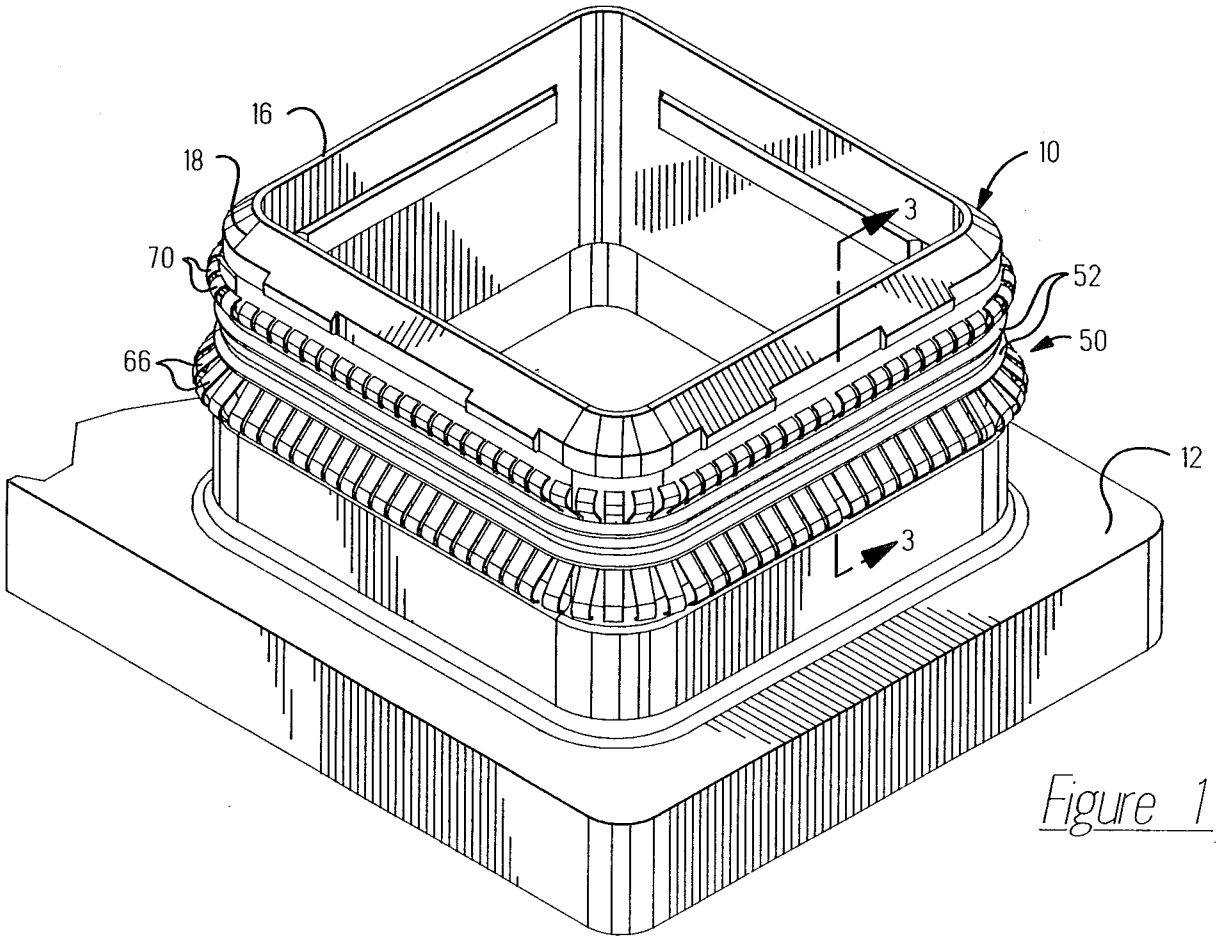
FIG. 1 is an isometric view showing a plug-type metal shell of an electrical connector, having an EMI strip according to the present invention secured therearound by two O-rings.

An electrical connector shell 10 is shown in FIG. 1 with an EMI strip 50 secured thereto by a pair of elastomeric O-ring members 52. Within the shell although not shown would be disposed a conventional dielectric insert containing a plurality of electrical terminals matable with terminals of a mating connector, also not shown. Shell 10 is shown as an integral portion of a plate 12 which may have a plurality of such shell portions.

Figure 2:
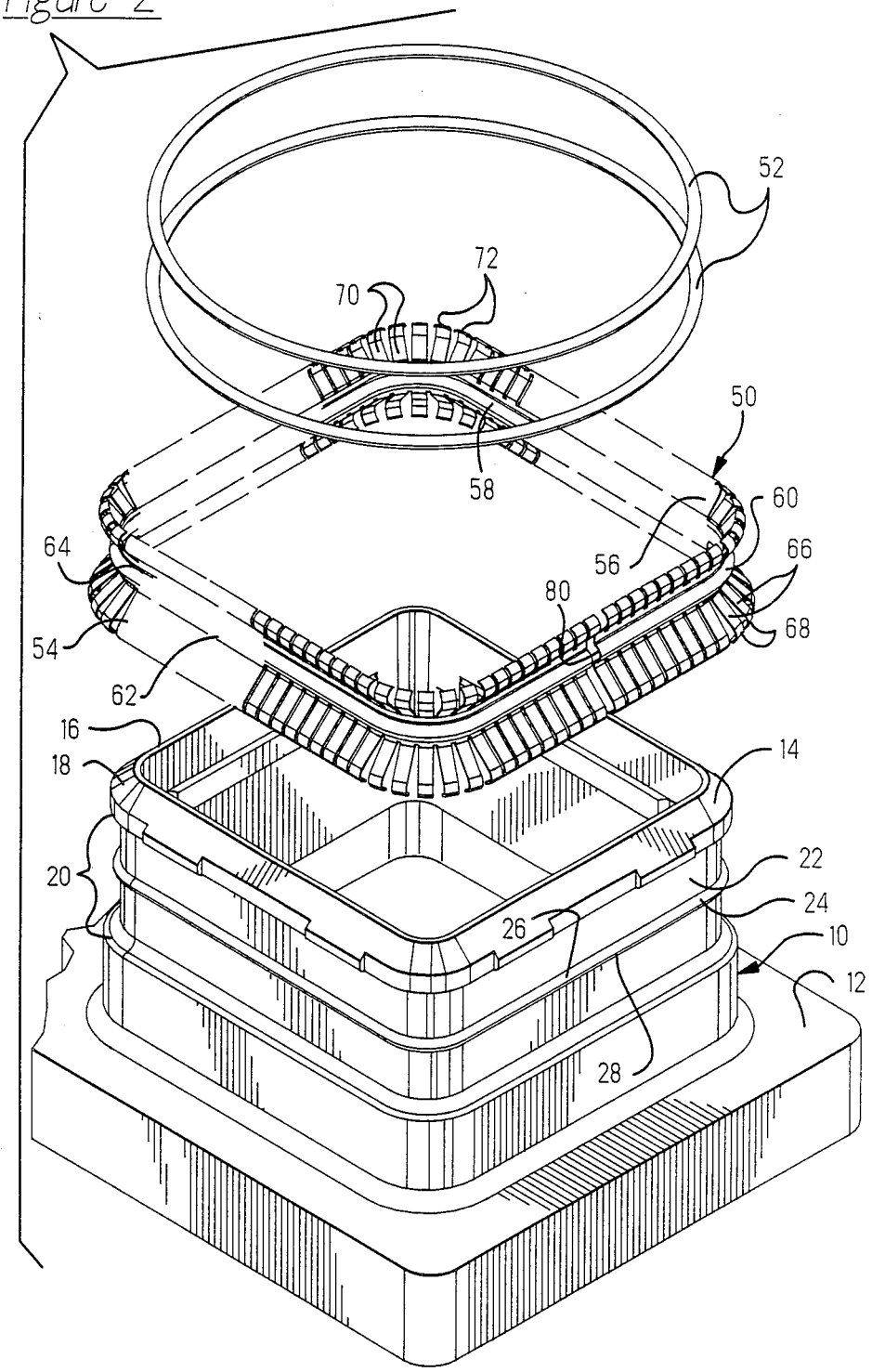
FIG. 2 shows the EMI strip and O-rings of FIG. 1 exploded from the shell.

In FIG. 2 shell 10 is shown as square and includes a plug section 14 having a forward end 16 and an outwardly tapered lead-in surface 18. The shell with which the present invention is useful could also be rectangular or circular, and could be die cast aluminum, machined metal, or metal-plated plastic or be otherwise conductive for connector shielding. A wide recess 20 within which EMI strip 50 will be seated is provided peripherally around the outer surface of shell 10 just rearwardly of lead-in surface 18. A small rounded ridge 24 extends around shell 10 in the center of recess bottom 22 and defines generally a forwardly facing stop surface 26 and a rearwardly facing stop surface 28 which will provide a means for securing the EMI strip 50 against axial movement during connector shell mating and unmating. Shell 10 and EMI strip 50 as shown are conventionally known, and ridge 24 was previously utilized for locating and aligning the EMI strip of corresponding shape but soldered thereto.

EMI strip 50 is preferably photoetched and formed in loose pieces of selected length such as of beryllim copper alloy, and includes an outwardly facing major surface 54 and an inwardly facing major surface 56. Body section 58 includes a central arcuate ridge 60 formed therein extending outwardly from major surface 54, and ring-receiving portions 62,64 on both sides of ridge 60. Extending rearwardly from ring-receiving portion 62 are a plurality of closely spaced first spring fingers 66, which also extend at a selected angle outwardly to free ends 68 which are curved inwardly. Extending forwardly from ring-receiving portion 64 are a plurality of closely spaced second spring fingers 70, which also extend at a selected angle outwardly to free ends 72 which are curved inwardly. Where EMI strip 50 is to be used with a rectangular shell, each strip is preferably formed into the shape of the shell prior to heat treatment. Where EMI strip 50 is to be used cylindrical shells, the strips may be stamped and formed on a continuous strip, and stored and shipped on reels. O-rings 52 may be made of conventional fluoroslicone rubber with a durometer of 60 or other elastomeric material, and having a circumference selected to be slightly smaller than the circumference of shell 10 along the bottom of recess 20 so that when located in place around strip 50 are slightly stretched.

Figure 3:
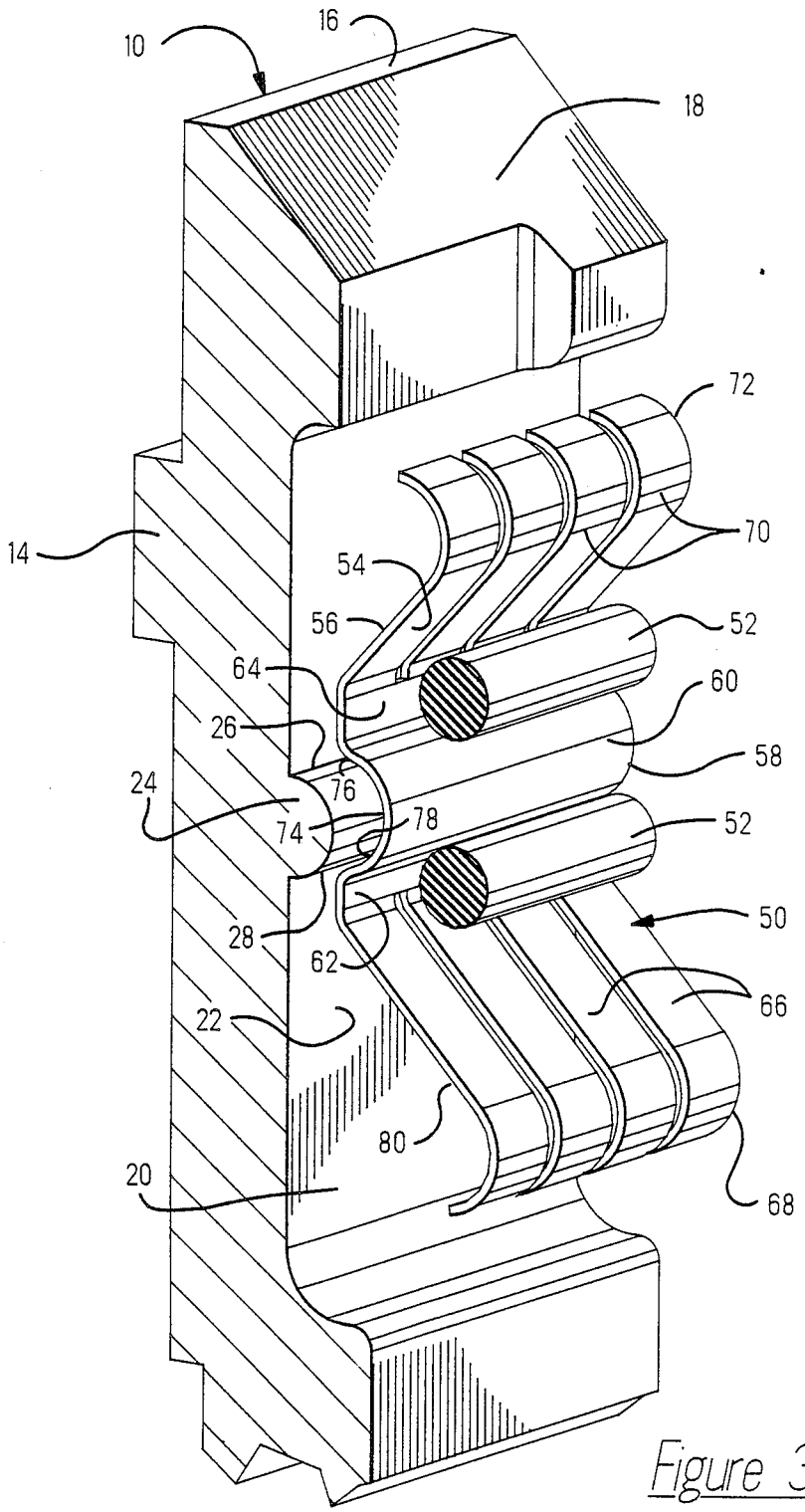
FIG. 3 is an enlarged part section view taken along line 3—3 of FIG. 1.
Figures 4A, 4B:
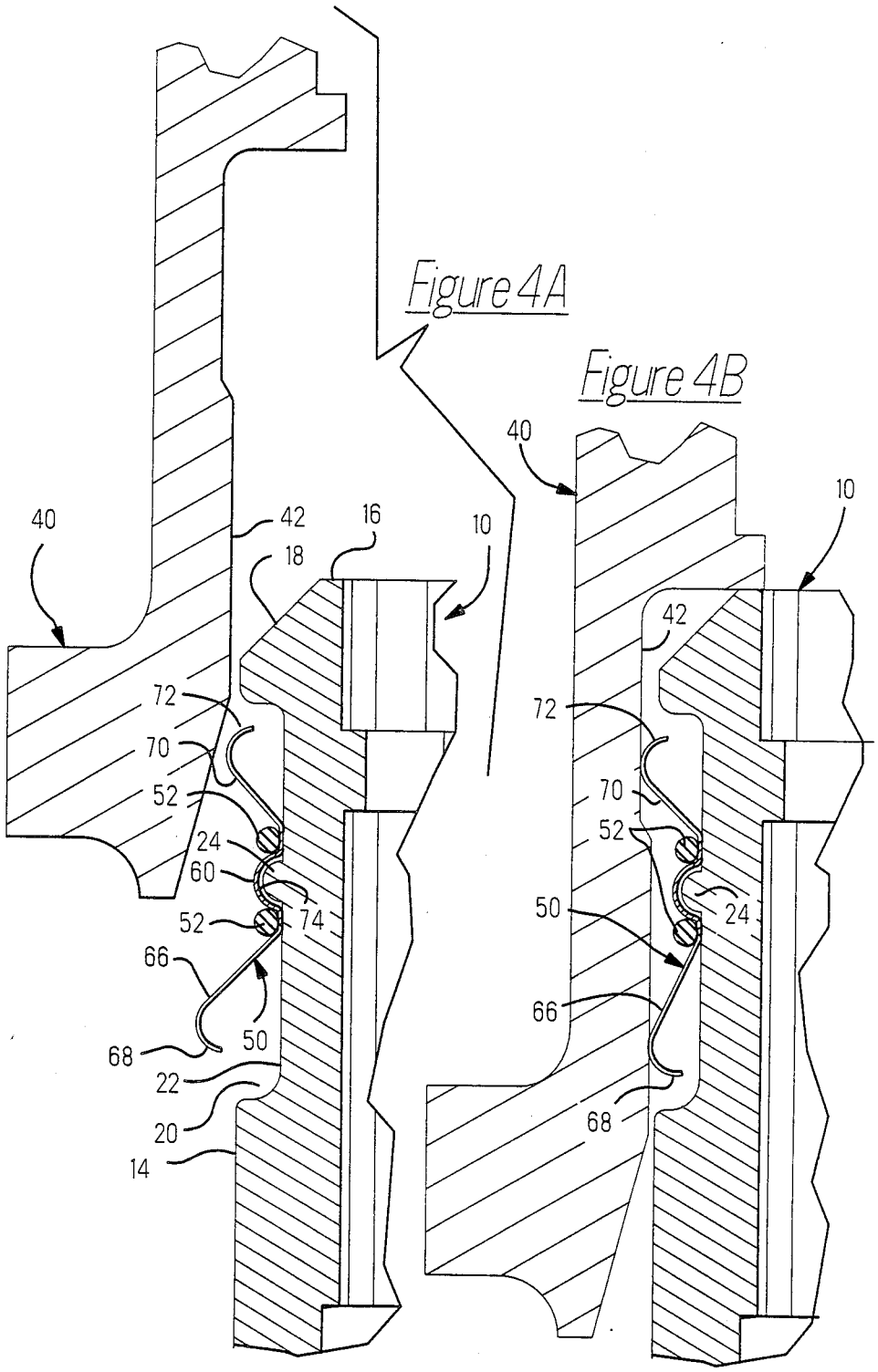
FIGS. 4A and 4B generally are enlarged part cross-sectional views of the assembly of FIG. 3, and also showing a mating shell, shown in mated engagement in FIG. 4B.

Referring to FIGS. 3 and 4A, central arcuate ridge 60 defines a coresponding groove 74 along inward major surface 56 which is formed to fit over ridge 24 in shell recess 20. A pair of O-rings 52 are placed one on each side of ridge 60 in respective ring-receiving sections 62,64 and hold strip 50 in place against shell 10. Corresponding groove 74 defines a rearwardly facing surface 76 to stop rearward axial movement of strip 50 along shell 10 when held against forwardly facing shell stop surface 26; corresponding groove 74 also defines a forwardly facing surface 78 to stop forward axial movement of strip 50 along shell 10 when held against rearwardly facing shell stop surface 28. With ends 80 remaining unattached to each other assembly of EMI strip 50 to the shell is facilitated. It is preferable for ends 80 to be slightly spaced rather than overlap, with perfect abutment not being realistically attainable. Eventual replacement is also facilitated, if replacement of the EMI strip becomes necessary after in-service use of the connector has begun.

Referring to FIGS. 4A and 4B, first spring arms 66 extend rearwardly and outwardly at an angle so that free ends 70 are engageable by an inside surface 42 of a mating shell 40 and deflected radially inwardly toward recess bottom 22. Second spring arms 68 extend forwardly and outwardly at an angle so that free ends 72 are engageable by inside surface 42 of mating shell 40 and also deflected radially inwardly. Second spring arms 68 are the first physical engagement between the connectors, and arms 68 serve to discharge the existing electrostatic potential between the connectors when free ends 72 first engage mating shell 40. First spring arms 66 continue to engage mating shell 40 after mating, and depending on the profile of the mating shell inner surface 42, second spring arms 68 also may continue to engage mating shell 40 after full mating.

Figure 5:
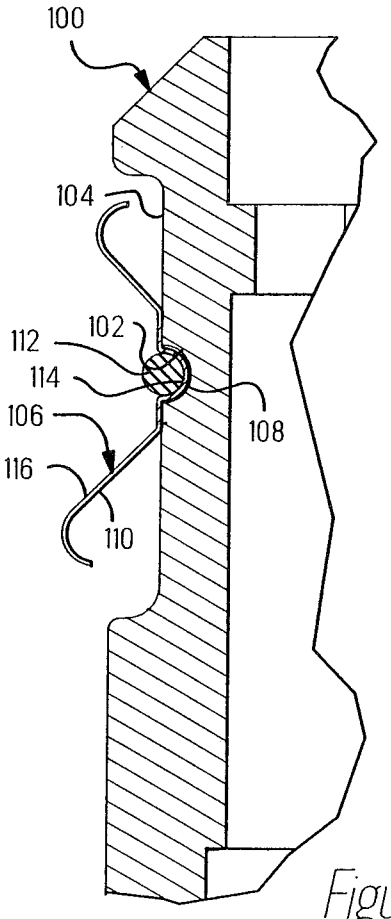

A second embodiment of the present inventin is shown in FIG. 5, which is a view similar to FIG. 4A.

Shell 100 includes a small groove 102 centrally along recess 104. EMI strip 106 includes a formed projection 108 extending inwardly from inward major surface 110 and shaped and dimensioned to fit within shell groove 102. A single elastomeric member 112 is disposed within corresponding groove 114 defined by formed projection 108 along outward major surface 116. The arrangement provides a system for preventing axial movement of EMI strip 106 with respect to shell 100.

Figure 7:
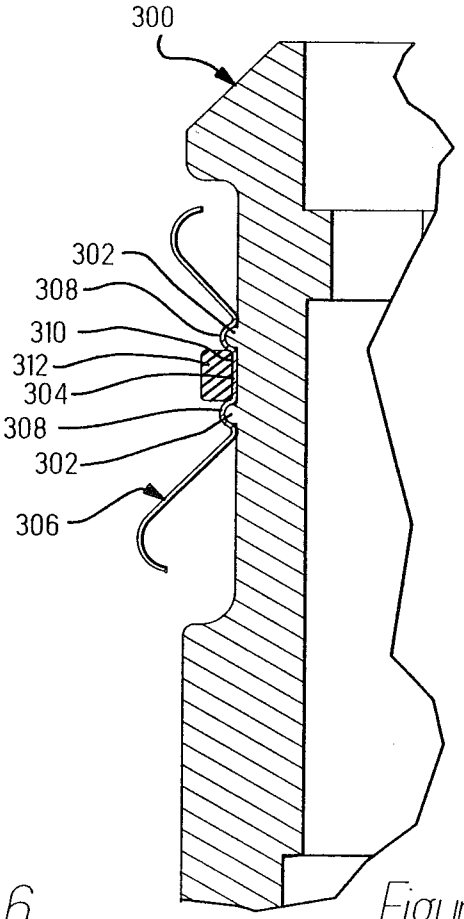
FIGS. 5 to 7 are similar to FIG. 4A showing alternate embodiments of the present invention.
Figure 6:
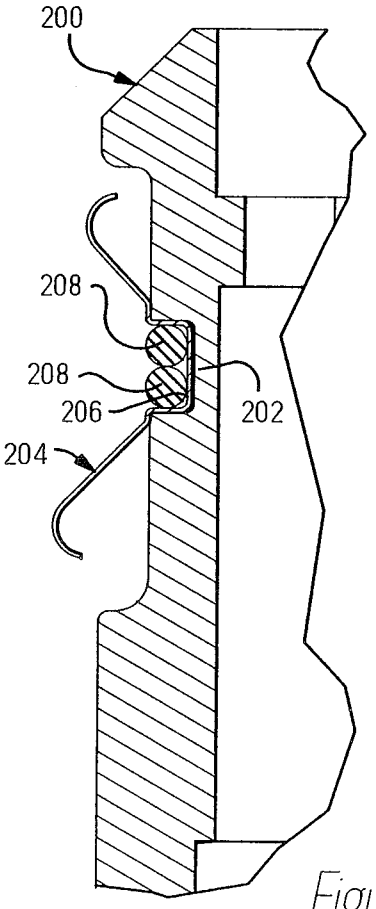

Third and fourth embodiments are shown in FIGS. 6 and 7. In FIG. 6 shell 200 includes a wide groove 202, EMI strip 204 includes a corresponding wide groove 206, and a pair of O-rings 208 are disposed therein side-by-side. In FIG. 7, shell 300 includes a pair of ridges 302 spaced apart thus defining a wide groove 304; EMI strip 306 includes a pair of corresponding radially outward ridges 308 which define a groove 310; and an elastomeric band 312 having a rectangular cross-section is seated within groove 310 which is located within shell groove 304. Forward and rearward stops are defined in each of the embodiments.

In either embodiment it is easily seen that the EMI strip is easily assembled to a shell using one or two O-rings, and is just as easily removed for replacement in the field by a like EMI strip and O-ring arrangement without special tools or involved process. The present invention enables not only continued use of the shells but also continued use of the shells in place without removal to another site for repair of the EMI protection mechanism, simply by removal of the O-rings and replacement of the damaged EMI strip and O-rings with like ones.

It is easily seen that the present invention may be used to retrofit certain connectors already in service having damaged EMI spring strips, which have utilized conventional EMI strip securing methods such as bonding, so long as the shell has a physical feature such as a ridge or groove to define forward and rearward stop surfaces, and an EMI strip is fabricated to correspond to the existing shell feature. The damaged EMI strip is removed, the material previously used is removed such as by solvents applied to remove adhesive or the shell locally heated along the outside surface to melt and remove solder which otherwise may tend to prevent accurate seating of the EMI strip of the present invention, and the EMI strip and elastomeric members are placed on the shell allowing continued use of the shell.

Further, for cylindrical shells the EMI strips may be retained on continuous strip on reels during original manufacture thereof and kept in reel form during assembly of the connector, needing only to be cut to an appropriate length at the assembly station, and is immediately usable with circular shells of any size without being formed into a continuous annular member, thereby greatly simplifying connector manufacture.

It can be seen that various modifications may be made to the particular embodiments disclosed herein in keeping with the spirit of the invention, within the scope of the claims.

What is claimed is:

1. A method for providing a means for conductively connecting a mating pair of plug-like and receptacle-like conductive shells of a pair of electrical connectors to protect against electromagnetic interference, comprising the steps of:

providing a plug-like conductive shell with a peripheral recess around the outer surface thereof rearwardly of a forward end thereof having a bottom surface defining a circumference, and providing along said recess bottom surface forwardly and rearwardly facing stop surfaces, said shell stop surfaces being spaced closely together and located approximately centrally of said peripheral recess;

selecting an elastomeric fastening means comprising at least one elastically deformable annulus having a circumference slightly less than said shell circumference along said recess bottom surface;

forming a metal strip including a body section and having outwardly and inwardly facing major surfaces, said forming to include forming on said metal strip a plurality of at least first spring fingers extending from said body section outwardly at an angle from said outwardly facing major surface and in one of a forwardly and rearwardly direction to free ends curved arcuately inwardly, and said forming to include forming on said body section a projection therealong extending outwardly from one of said outwardly and inwardly facing surfaces defining a corresponding groove extending into the other of said outwardly and inwardly facing surfaces and further defining forwardly and rearwardly facing surfaces corresponding respectively to said rearwardly and forwardly facing shell stop surfaces and adapted to fit thereagainst in stopping engagement upon said metal strip being disposed and secured within said peripheral shell recess;

forming said metal strip to have a length approximately equal to said shell circumference along said recess bottom surface;

disposing said metal strip in and along said peripheral shell recess with said inwardly facing strip surface against said recess bottom surface and said corresponding said forwardly and rearwardly facing strip surfaces against said rearwardly and forwardly facing shell stop surfaces; and securing said metal strip to said shell and against axial movement therealong by placing said elastomeric fastening means around said metal strip along said outwardly facing surface thereof intermediate said firt and second spring arms and proximate said forwardly and rearwardly facing shell stop surfaces, said elastomeric fastening means being stretched to hold said metal strip against said recess bottom surface and to hold said rearwardly facing strip surface against said forwardly facing shell stop surface and said forwardly facing strip surface against said rearwardly facing shell stop surface, whereby removal and replacement of said metal strip is facilitated.

2. A method as set forth in claim 1 wherein said shell includes a ridge along said recess bottom surface defining said forwardly and rearwardly facing shell stop surfaces, said strip projection extends outwardly from said outwardly facing strip major surface adapted to just fit over said ridge, and said elastomeric fastening means comprises two elastomeric rings which are disposed just forwardly and just rearwardly of said strip projection.

3. A method as set forth in claim 1 wherein said shell includes a pair of ridges spaced apart to define a groove therebetween, and said strip includes corresponding radially outwardly extending ridges adapted to fit over said shell ridges and defining a groove therebetween extending radially inwardly within which said elastomeric fastening means is disposed.

4. A method as set forth in claim 3 wherein said elastomeric fastening means is a pair of O-rings side-by-side.

5. A method as set forth in claim 3 wherein said elastomeric fastening means is a band having a rectangular cross-section.

6. A method as set forth in claim 1 wherein said shell includes a groove along said recess bottom surface defining said forwardly and rearwardly facing shell stop surfaces, said strip projection extends outwardly from said inwardly facing strip major surface adapted to just fit within said groove, and said elastomeric fastening means adapated to fit within said corresponding groove defined by said strip projection.

7. A method as set forth in claim 6 wherein said shell groove and said corresponding strip groove are narrow and said elastomeric fastening means is an O-ring.

8. A method as set forth in claim 6 wherein said shell groove and said corresponding strip groove are wide and said elastomeric fastening means comprises a plurality of O-rings.

9. A method as set forth in claim 6 wherein said shell groove and said corresponding strip groove are wide and said elastomeric fastening means comprises a band-having a rectangulr cross-section.

10. A method as set forth in claim 1 wherein said providing step comprises removing a damaged EMI strip from a preexisting in-service plug-like shell, defining a retrofit method.

11. A method as set forth in claim 1 wherein said metal strip is cut to said length at the site of connector assembly.

12. A method as set forth in claim 1 wherein said plug-like conductive shell is rectangular, and said forming includes shaping a length of said metal strip to conform to the rectangular shape of said shell.

13. An assembly of an electrical connector conductive plug-like shell and a means therearound for providing conductive engagement with a mated electrical connector conductive receptacle-like shell therearound, comprising:

a conductive plug-like shell having a peripheral recess around the outer surface thereof rearwardly of a forward end thereof, a metal strip within said peripheral recess and around said shell, and elastomeric fastening means around said metal strip securing said metal strip to said shell, said metal shell having at least first spring fingers therealong extending outwardly from said recess and disposed and adapted to be engaged by a mating connector receptacle-like conductive shell and be deflected radially inwardly thereby toward said recess bottom, establishing grounding engagement with said mating shell;

said peripheral shell recess having a bottom surface defining a circumference, said recess bottom surface having forwardly and rearwardly facing stop surfaces spaced closely together and located approximately centrally of said peripheral recess;

said metal strip including a body section having a length approximately equal to said circumference, said metal strip having outwardly and inwardly facing major surfaces, said metal strip further including a plurality of said at least first spring fingers extending from said body section outwardly at an angle from said outwardly facing major surface and in one of a forwardly and rearwardly direction to free ends curved arcuately inwardly;

said metal strip further including on said body section a projection formed therealong extending outwardly from one of said outwardly and inwardly facing surfaces defining a corresponding groove extending into the other of said outwardly and inwardly facing surfaces and further defining forwardly and rearwardly facing surfaces corresponding respectively to said rearwardly and forwardly facing shell stop surfaces and adapted to fit thereagainst in stopping engagement upon said metal strip being disposed and secured within said peripheral shell recess;

said metal strip being disposed in and along said peripheral shell recess with said inwardly facing strip surface against said recess bottom surface and said corresponding said forwardly and rearwardly facing strip surfaces against said rearwardly and forwardly facing shell stop surfaces; and said elastomeric fastening means comprising at least one elastically deformable annulus having a circumference slightly less than said shell circumference along said recess bottom surface, securing said metal strip to said shell and against axial movement therealong by being stretched to hold said metal strip against said recess bottom surface and to hold said rearwardly facing strip surface against said forwardly facing shell stop surface and said forwardly facing strip surface against said rearwardly facing shell stop surface, whereby said metal strip is removable upon removal of said elastomeric means and a like metal strip is securable thereon with a like said elastomeric means facilitating repair.

14. An assembly as set forth in claim 13 wherein said shell includes a ridge along said recess bottom surface defining said forwardly and rearwardly facing shell stop surfaces, said strip projection extends outwardly from said outwardly facing strip major surface and defines a said corresponding groove adapted to just fit over said ridge, and said elastomeric fastening means comprises two elastomeric rings which are disposed just forwardly and just rearwardly of said strip projection.

15. An assembly as set forth in claim 13 wherein said shell includes a groove along said recess bottom surface defining said forwardly and rearwardly facing stop surfaces, said strip projection extends outwardly from said inwardly facing strip major surface adapted to just fit within said groove, and said elastomeric fastening means comprises one elastomeric ring which is disposed within said corresponding groove defined by said strip projection.

16. An assembly as set forth in claim 13 wherein said metal strip includes a plurality of second spring fingers extending in the other of said forwardly and rearwardly directions to free ends curved arcuately inwardly.

17. An assembly as set forth in claim 13 wherein said conductive plug-like shell is rectangular.

* * * * *

UNITED STATES PATENT OFFICE

CERTIFICATE OF CORRECTION

Patent No. 4,874,337 Dated October 17, 1989

Inventor(s) Edward J. Paukovits, Jr. and Susan E. Wright

It is certified that error appears in the above-identified patent and that said Letters Patent is hereby corrected as shown below:

In the Abstract:

Line 8, "32" should be --22--.

In the Claims:

Claim 1, Column 6, Line 43, the word "firt" should be --first--.

Signed and Sealed this

Twenty-seventh Day of November, 1990

*Attest:*

HARRY F. MANBECK, JR.

*Attesting Officer*

*Commissioner of Patents and Trademarks*